US010596826B2

(12) United States Patent
Shimozono et al.

(10) Patent No.: US 10,596,826 B2
(45) Date of Patent: Mar. 24, 2020

(54) THERMAL HEAD AND THERMAL PRINTER

(71) Applicant: KYOCERA Corporation, Kyoto-shi, Kyoto (JP)

(72) Inventors: Takahiro Shimozono, Okaya (JP); Kouji Shimada, Okaya (JP); Arata Okayama, Uji (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 15/763,367

(22) PCT Filed: Sep. 27, 2016

(86) PCT No.: PCT/JP2016/078460
§ 371 (c)(1),
(2) Date: Mar. 26, 2018

(87) PCT Pub. No.: WO2017/057364
PCT Pub. Date: Apr. 6, 2017

(65) Prior Publication Data

US 2018/0281452 A1 Oct. 4, 2018

(30) Foreign Application Priority Data

Sep. 28, 2015 (JP) ..... 2015-189895
Feb. 25, 2016 (JP) ..... 2016-034515

(51) Int. Cl.
*B41J 2/335* (2006.01)

(52) U.S. Cl.
CPC ..... *B41J 2/3352* (2013.01); *B41J 2/3351* (2013.01); *B41J 2/3353* (2013.01); *B41J 2/3354* (2013.01);
(Continued)

(58) Field of Classification Search
CPC ..... B41J 2/3357; B41J 2/3353; B41J 2/335; B41J 2/3351; B41J 2/33515; B41J 2/3352; B41J 2/3354
See application file for complete search history.

(56) References Cited

U.S. PATENT DOCUMENTS 5,223,855 A * 6/1993 Ota ..... B41J 2/3352 347/209
7,190,386 B2 * 3/2007 Yamamoto ..... B41J 2/3353 347/208
(Continued)

FOREIGN PATENT DOCUMENTS

JP 11129513 A * 5/1999 ..... B41J 2/335
JP 11157110 A * 6/1999 ..... B41J 2/335
(Continued)

OTHER PUBLICATIONS

Machine translation of JP 11-129513, published on May 1999. (Year: 1999).*
(Continued)

*Primary Examiner* — Huan H Tran
(74) *Attorney, Agent, or Firm* — Volpe and Koenig, P.C.

(57) ABSTRACT

A thermal head includes: a head base body including a substrate and a plurality of heat generating sections disposed on the substrate; connection portions which are electrically connected to the head base; a connection member which is electrically connected to the connection portions; and a first cover member which covers the connection portions, the first cover member including a plurality of protruding portions provided on an upper surface of the first cover member at predetermined intervals in a main scanning direction.

14 Claims, 7 Drawing Sheets

(52) U.S. Cl.
CPC ..... *B41J 2/3357* (2013.01); *B41J 2/33515* (2013.01); *B41J 2/33525* (2013.01)

(56) References Cited

U.S. PATENT DOCUMENTS

| | | | | |
|---|---|---|---|---|
| 9,050,826 | B2 * | 6/2015 | Hirose | B41J 2/3351 |
| 9,333,765 | B2 * | 5/2016 | Moto | B41J 2/3352 |
| 9,403,376 | B2 * | 8/2016 | Noda | B41J 2/335 |
| 9,573,384 | B2 * | 2/2017 | Yoneta | B41J 2/3351 |
| 2006/0098080 | A1 | 5/2006 | Yamamoto et al. | |
| 2014/0132696 | A1 * | 5/2014 | Moto | B41J 2/3351 347/211 |
| 2015/0298464 | A1 * | 10/2015 | Moto | B41J 2/3352 347/211 |
| 2015/0352858 | A1 * | 12/2015 | Noda | B41J 2/335 347/211 |

FOREIGN PATENT DOCUMENTS

| | | | | | |
|---|---|---|---|---|---|
| JP | 11240189 | A | * | 9/1999 | B41J 2/335 |
| JP | 2004-148577 | A | | 5/2004 | |
| JP | 2014104715 | A | * | 6/2014 | B41J 2/335 |
| WO | WO-2015115485 | A1 | * | 8/2015 | B41J 2/3351 |

OTHER PUBLICATIONS

Machine translation of JP 11-157110, published on Jun. 1999. (Year: 1999).*
Machine translation of JP 11-240189, published on Sep. 1999. (Year: 1999).*
Google translation of JP 11-240189, published on Sep. 1999. (Year: 1999).*
Google translation of JP 11-157110, published on Jun. 1999. (Year: 1999).*
Google translation of JP 2014-104715, published on Jun. 2014. (Year: 2014).*

* cited by examiner

THERMAL HEAD AND THERMAL PRINTER

TECHNICAL FIELD

The present invention relates to a thermal head and a thermal printer.

BACKGROUND ART

In the related art, various thermal heads have been proposed as printing devices such as facsimiles or video printers. For example, there is known a thermal head including a substrate, a head base body including a plurality of heat generating sections disposed on the substrate, a connection member which connects the head base body to an outside via connection portions, and a first cover member covering the connection portions (for example, see Patent Literature 1).

CITATION LIST

Patent Literature

Patent Literature 1: Japanese Unexamined Patent Publication JP-A 2004-148577

SUMMARY OF INVENTION

A thermal head according to the present disclosure includes a head base body, a connection member, and a first cover member. The head base body includes a substrate and a plurality of heat generating sections disposed on the substrate. The connection member connects the head base body to an outside via connection portions. The first cover member covers the connection portions. The first cover member includes a plurality of protruding portions provided on an upper surface of the first cover member at predetermined intervals in a main scanning direction.

A thermal head according to the present disclosure includes a head base body, a wiring substrate, a connection member, and a first cover member. The head base body includes a substrate and a plurality of heat generating sections disposed on the substrate. The wiring substrate is disposed so as to be adjacent to the head base body and is electrically connected thereto. The connection member connects the wiring substrate to an outside via connection portions. The first cover member covers the connection portions. The first cover member includes a plurality of protruding portions provided on an upper surface of the first cover member at predetermined intervals in a main scanning direction.

A thermal printer according to the present disclosure includes: the thermal head mentioned above; a conveyance mechanism which conveys a recording medium on the heat generating sections; and a platen roller which presses a recording medium against a top of the heat generating sections.

BRIEF DESCRIPTION OF DRAWINGS

FIGS. 1A and 1B illustrate a thermal head according to a first embodiment, wherein FIG. 1A is a plan view illustrating a schematic configuration, and FIG. 1B is an explanation view illustrating a cross section of the schematic configuration;

FIGS. 6A and 6B illustrate a thermal head according to a second embodiment, wherein FIG. 6A is a plan view illustrating a schematic configuration, and FIG. 6B is an explanation view illustrating a cross section the schematic configuration;

DESCRIPTION OF EMBODIMENTS

Figure 1A:
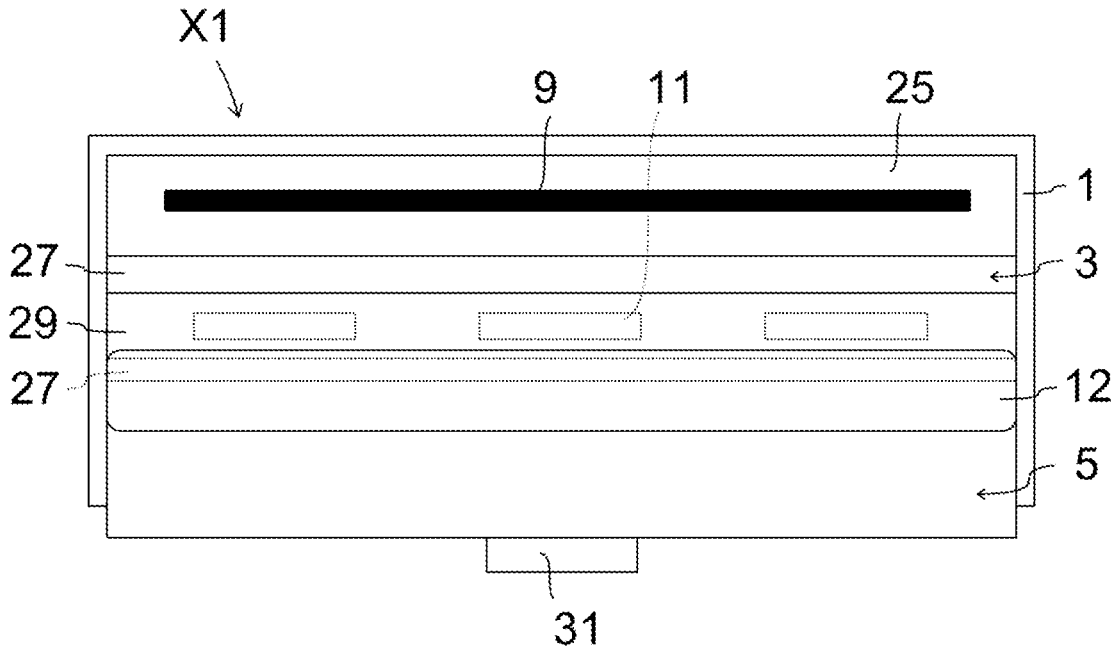

Hereinafter, embodiments will be described with reference to the drawings. The drawings to be described below are schematic, and dimensions, scales, and the like in the drawings do not necessarily match actual dimensions, scales, and the like. Even in the plurality of drawings illustrating the same members, dimensions, scales, and the like do not match each other to exaggerate the shapes or the like in some cases.

First Embodiment

Figure 1B:
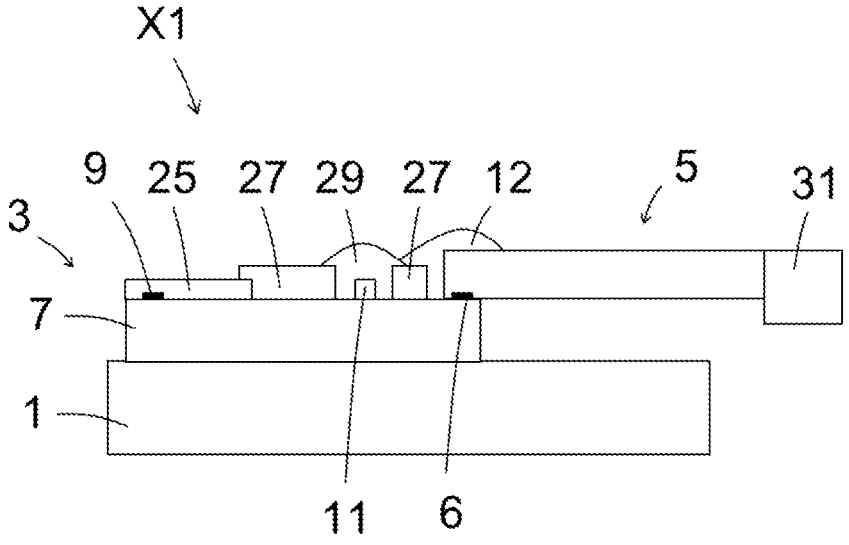
Figure 2:
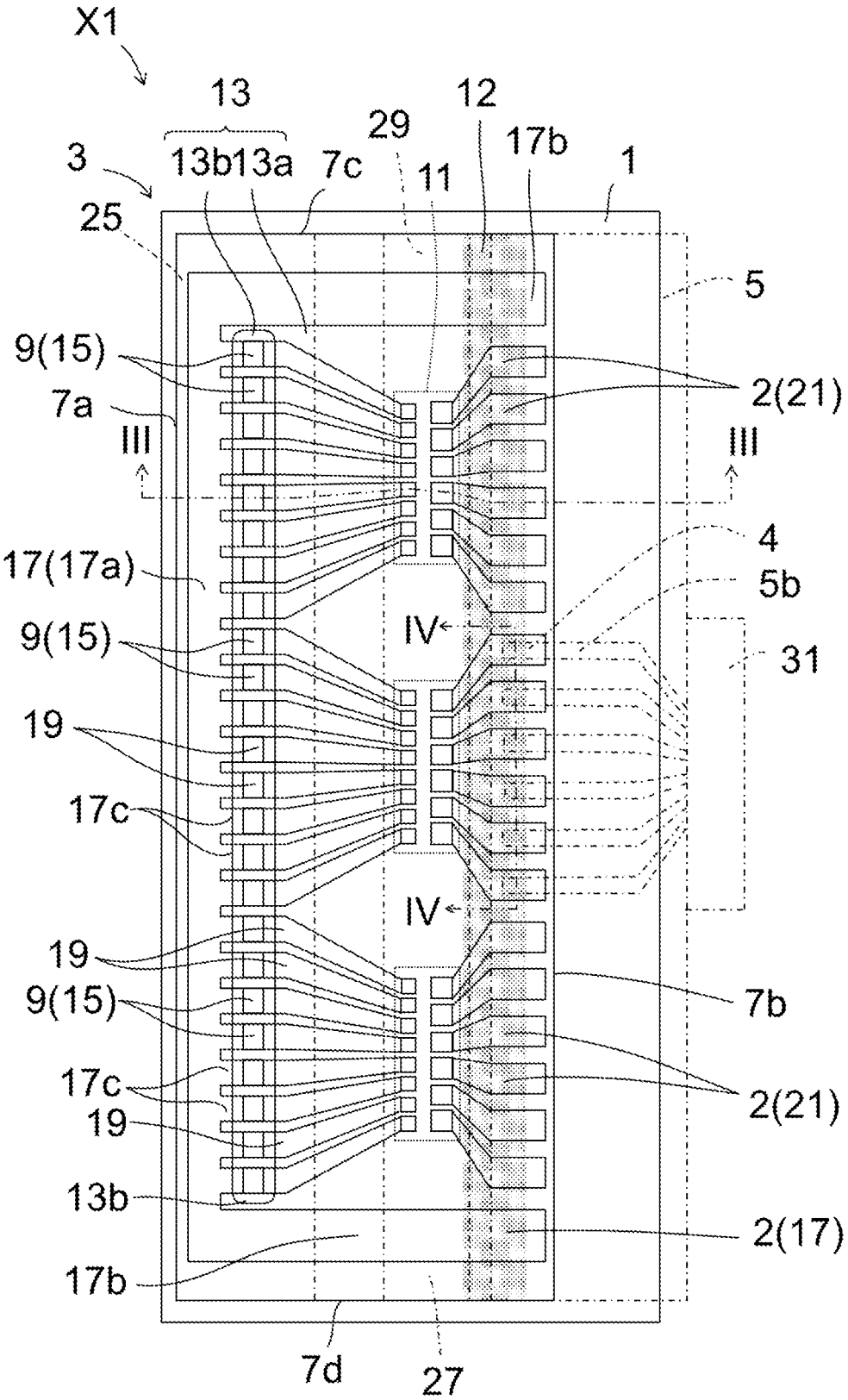
FIG. 2 is a plan view illustrating the thermal head according to the first embodiment.

Hereinafter, a thermal head X1 will be described with reference to FIGS. 1A to 4. FIGS. 1A and 1B illustrate a schematic configuration of the thermal head X1. A heat generating section 9 and a connection portion 6 are indicated by a thick line, and a thermal storage layer 13 is not illustrated. In FIG. 2, a protective layer 25, a second cover member 29, a cover layer 27, a flexible printed circuit 5 (hereinafter referred to as an FPC 5), and a connector 31 are indicated by one-dot chain lines, although not illustrated. In FIG. 2, a first cover member 12 is indicated by a plurality of dots. In FIG. 2, some of wiring conductors 5*b* of the FPC 5 are selectively illustrated.

The thermal head X1 includes a heat dissipating plate 1, a head base body 3, the FPC 5 which is a connection member, and the first cover member 12. The head base body 3 is placed on the heat dissipating plate 1, and the FPC 5 is electrically connected. The head base body 3 and the FPC 5 are electrically connected to each other via a connection portion 6. The first cover member 12 is provided on the head base body 3 and the FPC 5 so as to cover the connection portion 6, and is formed to be long in a main scanning direction. The connector 31 is electrically connected to the FPC 5, and thus the thermal head X1 is electrically connected to the outside.

The heat dissipating plate 1 is formed of, for example, a metal material such as copper, iron, or aluminum. The heat dissipating plate 1 functions to dissipate part of the heat the heat evolved in the heat generating section 9 of the head base body 3 which part is not conducive to printing. The heat dissipating plate 1 is formed in a rectangular shape in a plan view. The head base body 3 is bonded on the upper surface of the heat dissipating plate 1 by a double-sided tape, an adhesive, or the like (not illustrated).

The head base body 3 is formed in a rectangular shape in a plan view. As illustrated in FIGS. 1A and 1B, the head base body 3 includes a substrate 7, the heat generating section 9, the protective layer 25, the cover layer 27, a driving IC (Integrated Circuit) 11, the first cover member 12, and the second cover member 29. Each member constituting the thermal head X1 is disposed on the substrate 7. The head base body 3 has a function of performing printing on a recording medium (not illustrated) in accordance with an electric signal supplied from the outside.

The protective layer 25 is formed to be long in the main scanning direction so as to cover the heat generating section 9. The cover layer 27 is disposed on the substrate 7 to be long in the main scanning direction. The driving IC 11 is disposed on the substrate 7 exposed from the cover layer 27. The plurality of driving ICs 11 are provided in the main scanning direction. The second cover member 29 covers the plurality of driving ICs 11 collectively. Therefore, the second cover member 29 is formed to be long in the main scanning direction.

Hereinafter, the head base body 3 and each member included in the FPC 5 will be described in detail with reference to FIGS. 2 and 3. In the first embodiment, the FPC 5 will be described as the connection member.

The substrate 7 is disposed on the heat dissipating plate and is formed in a rectangular shape in a plan view. Therefore, the substrate 7 includes a first long side 7*a*, a second long side 7*b*, a first short side 7*c*, and a second short side 7*d*. The substrate 7 is formed of, for example, an electrically insulating material such as alumina ceramics or a semiconductor material such as a monocrystalline silicon.

The thermal storage layer 13 is formed on the upper surface of the substrate 7. The thermal storage layer 13 includes an underlying portion 13*a* and a bulge portion 13*b*. The underlying portion 13*a* is formed across the left half of the upper surface of the substrate 7. The bulge portion 13*b* extends in a belt shape in the main scanning direction and has a cross section formed in a substantially semielliptical shape. The bulge portion 13*b* has a function of pressing a recording medium P (see FIG. 5B) to be printed satisfactorily against the protective layer 25 disposed on the heat generating section 9.

The thermal storage layer 13 is formed of glass with low thermal conductivity. The thermal storage layer 13 temporarily stores part of the heat generated by the heat generating section 9. Thus, it is possible to shorten a time necessary to increase the temperature of the heat generating section 9. Therefore, it is possible to improve a thermal responsive property of the thermal head X1.

The thermal storage layer 13 can be formed, for example, by applying a predetermined glass paste obtained by mixing an appropriate organic solvent with glass powder to the upper surface of the substrate 7 using heretofore known screen printing or otherwise, and firing the applied glass paste at high temperature.

An electrical resistance layer 15 is disposed on the upper surface of the thermal storage layer 13. Terminals 2, a common electrode 17, discrete electrodes 19, and connection electrodes 21 are disposed on the electrical resistance layer 15. The electrical resistance layer 15 is patterned with the same shape as the terminals 2, the common electrode 17, the discrete electrodes 19, and the connection electrodes 21. The electrical resistance layer 15 has exposed regions in which the electrical resistance layer 15 is exposed from the various electrodes between the common electrode 17 and the discrete electrodes 19. As illustrated in FIG. 2, the exposed regions of the electrical resistance layer 15 are arranged in line on the bulge portion 13*b* of the thermal storage layer 13. Each exposed region of the electrical resistance layer 15 forms the heat generating section 9.

The electrical resistance layer 15 may not be patterned with the same shape as the terminals 2, the common electrode 17, the discrete electrodes 19, and the connection electrodes 21. For example, the electrical resistance layer 15 may be disposed only between the common electrode 17 and the discrete electrodes 19 to form the heat generating section 9.

The heat generating section 9, while being illustrated in simplified form in FIGS. 1A and 1B for convenience in explanation, is arranged at a density of 100 dpi (dot per inch) to 2400 dpi, for example.

The electrical resistance layer 15 is formed of a material having a relatively high electrical resistance value such for example as a TaN-based material, a TaSiO-based material, a TaSiNO-based material, a TiSiO-based material, a TiSiCO-based material, or a NbSiO-based material. Hence, upon application of a voltage to the heat generating section 9, the heat generating section 9 generates heat under Joule heating effect.

The common electrode 17, the discrete electrodes 19, and the connection electrodes 21 are disposed on the upper surface of the electrical resistance layer 15. The common electrode 17, the discrete electrodes 19, and the connection electrodes 21 are formed of a material with conductivity. For example, these electrodes are formed of one of metal of aluminum, gold, silver, and copper or an alloy thereof.

The common electrode 17 includes main wiring portions 17*a*, sub wiring portions 17*b*, and lead portions 17*c*. The main wiring portion 17*a* extends along a first long side 7*a* of the substrate 7. Two sub wiring portions 17*b* extend along a first short side 7*c* and a second short side 7*d* of the substrate 7. The plurality of lead portions 17*c* individually extend from the main wiring portion 17*a* to each heat generating section 9. The common electrode 17 includes the terminals 2 connected to external terminals 4 on the side of a second long side 7*b* of the substrate 7.

The plurality of discrete electrodes 19 electrically connect the heat generating sections 9 to the driving ICs 11. For the discrete electrodes 19, the plurality of heat generating sections 9 are divided into a plurality of groups, and thus the heat generating sections 9 of each group are electrically connected to the driving IC 11 provided to correspond to each group.

A plurality of connection electrodes 21 electrically connect the driving ICs 11 to the connector 31. The plurality of connection electrodes 21 connected to each driving IC 11 are constituted by a plurality of wirings with different functions. The connection electrode 21 includes the terminal 2 connected to the connection portion 6 on the side of the second long side 7*b* of the substrate 7.

The terminal 2 is provided in the common electrode 17 and the connection electrode 21 to connect the head base body 3 to the FPC 5, and is disposed on the side of the second long side 7*b* of the substrate 7. The terminal 2 is formed by a part of the common electrode 17 and a part of the connection electrode 21.

The electrical resistance layer 15, the common electrode 17, the discrete electrodes 19, and the connection electrodes 21 can be formed in accordance with, for example, the following method. First, respective material layers are sequentially stacked on the thermal storage layer 13 by, for example, a heretofore known thin film forming technology such as a sputtering method. Subsequently, the material layers are formed by processing a stacked body in a predetermined pattern using a heretofore known photoetching or otherwise. The electrical resistance layer 15, the common electrode 17, the discrete electrodes 19, and the connection electrodes 21 can be simultaneously formed through the same processes.

The protective layer 25 covering the heat generating sections 9, a part of the common electrode 17, and parts of the discrete electrodes 19 is formed on the thermal storage layer 13 formed on the upper surface of the substrate 7.

The protective layer 25 protects the heat generating section 9 and the covered areas of the common electrode 17 and the discrete electrode 19 against corrosion caused by adhesion of atmospheric water content, etc., or against wear caused by contact with a recording medium under printing. The protective layer 25 may be formed of an inorganic material such as SiN, $SiO_2$, SiON, SiC, or diamond-like carbon. The protective layer 25 may be formed of a single layer or may be formed by stacking such layers. The protective layer 25 may be produced by thin-film forming technique such as sputtering, or thick-film forming technique such as screen printing.

On the substrate 7, there is provided a cover layer 27 which partly covers the common electrode 17, the discrete electrode 19, and the connection electrode 21. The cover layer 27 protects the covered areas of the common electrode 17, the discrete electrode 19, the IC-IC connection electrode 26, and the connection electrode 21 against oxidation caused by exposure to air. The cover layer 27 serves to protect the various electrodes against corrosion caused due to adherence of moisture contained in the air.

The driving ICs 11 are disposed to correspond to each group of the plurality of heat generating sections 9. The driving ICs 11 connect the discrete electrodes 19 to the connection electrodes 21. The plurality of driving ICs 11 are provided at predetermined intervals in the main scanning direction. The predetermined intervals are, for example, about 1 mm to 20 mm.

The driving IC 11 has a function of controlling a conductive state of each heat generating section 9. As the driving IC 11, for example, a switching member containing a plurality of switching elements is used. The driving ICs 11 are sealed by the second cover member 29.

The second cover member 29 is formed astride the plurality of driving ICs 11 to extend in the main scanning direction. The second cover member 29 covers the driving ICs 11 so that the driving ICs 11 are not exposed. The second cover member 29 also covers connection regions of the driving ICs 11 and the wirings.

The second cover member 29 can be formed of, for example, a thermosetting resin such as an epoxy resin or a silicone resin. The second cover member 29 can be formed using an ultraviolet-curable resin, a visible light-curable resin, or the like.

The FPC 5 includes a base member 5*a*, a plurality of wiring conductors 5*b*, and a cover member 5*c*. The base member 5*a* is formed in a rectangular shape in a plan view, and thus has the external shape as the FPC 5. The plurality of wiring conductors 5*b* are disposed on the base member 5*a* and are provided at predetermined intervals in the main scanning direction. An external terminal 4 electrically connected to the terminal 2 is disposed at an end of each of the plurality of wiring conductors 5*b*. Therefore, the plurality of external terminals 4 are provided apart from each other at the predetermined intervals in the main scanning direction. The cover member 5*c* is formed on the base member 5*a* to cover the wiring conductors 5*b*. The cover member 5*c* is partially notched so that the external terminals 4 are exposed. The wiring conductors 5*b* and the external terminals 4 may be formed of the same material to be integrated. In this case, portions of the wiring conductors 5*b* exposed from the cover member 5*c* serve as the external terminals 4.

The connector 31 is electrically connected to the wiring conductors 5*b*, sockets are inserted into the housing of the connector 31 from the outside, and the thermal head X1 is electrically connected to the outside.

Figure 3:
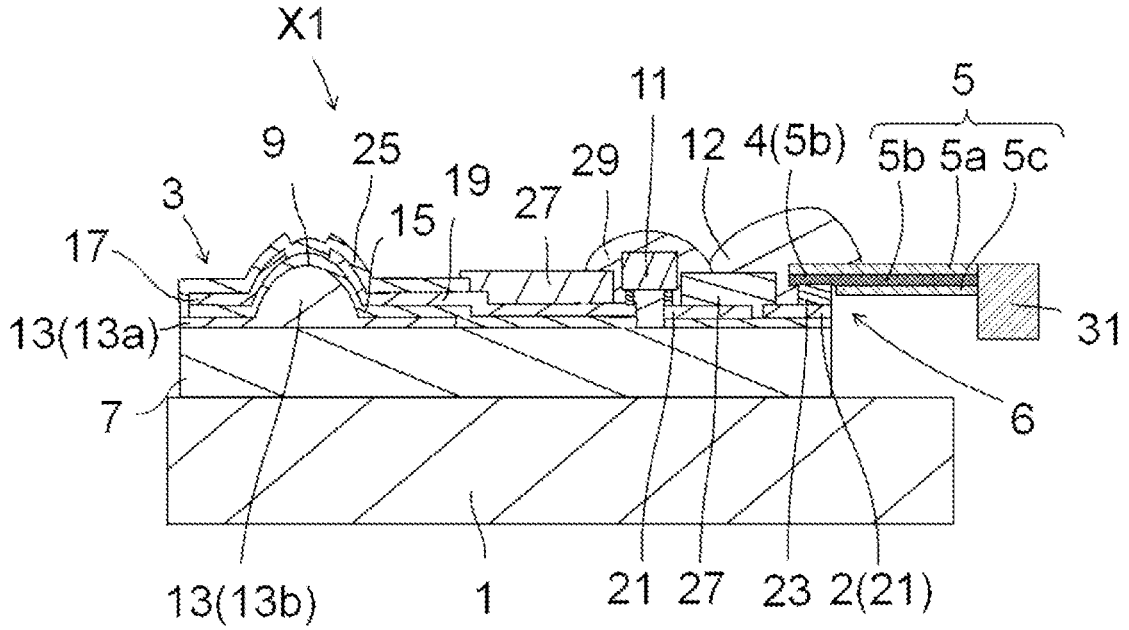
FIG. 3 is a sectional view taken along the line illustrated in FIG. 2.

As illustrated in FIG. 3, a conductive member 23 is disposed between the terminal 2 and the external terminal 4. The conductive member 23 electrically connects the terminal 2 to the external terminal 4. Examples of the conductive member 23 include, for example, solder or an anisotropic conducting adhesive. In the embodiment, the case where solder is used is described. A plated layer (not illustrated) formed of Ni, Au, or Pd may be disposed between the conductive member 23 and the terminal 2.

The connection portion 6 is a portion which electrically connects the head base body 3 to the FPC 5 (connection member). Therefore, in the first embodiment, the connection portion 6 means the conductive member 23.

The plurality of external terminals 4 are provided at predetermined intervals in the main scanning direction. Therefore, the plurality of connection portions 6 are also provided at the predetermined intervals in the main scanning direction. In the FPC 5, a region in which the connection portions 6 are arranged is referred to as a connection region (not illustrated) below. In other words, the connection region is a region between the external terminal 4 located on the farthest side of the first short side 7*c* of the substrate 7 and the external terminal 4 located on the farthest side of the second short side 7*d* of the substrate 7 in a plan view.

The first cover member 12 serves to protect the connection region. Therefore, the first cover member 12 is disposed on the head base body 3 and the FPC 5 to extend in the main scanning direction. That is, the first cover member 12 extends from the connection region of the FPC 5 to the head base body 3 adjacent to the connection region in a sub-scanning direction.

The first cover member 12 can be formed of a thermosetting resin such as an epoxy resin or a silicone resin as in the second cover member 29. The first cover member 12 can be formed of an ultraviolet-curable resin, a visible light-curable resin, or the like.

Figure 4:
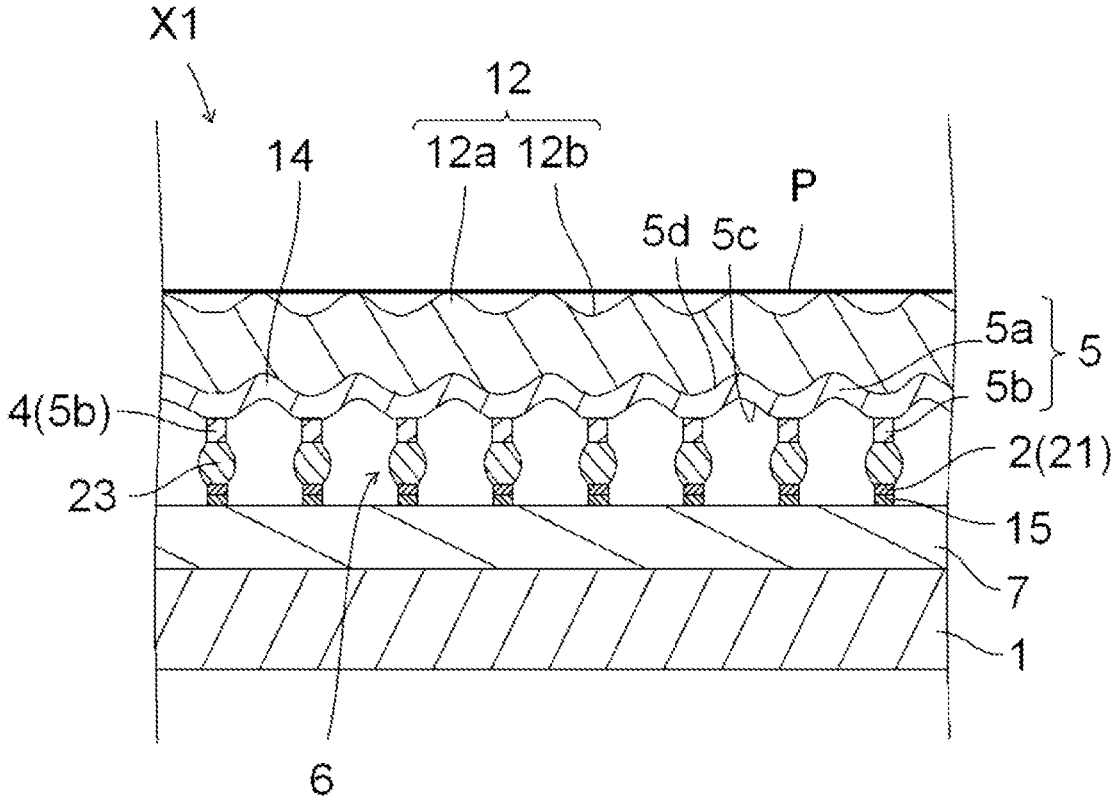
FIG. 4 is a sectional view taken along the line IV-IV illustrated in FIG. 2.

The first cover member 12 and the FPC 5 will be described in detail with reference to FIG. 4. In FIG. 4, the recording medium P being conveyed is schematically indicated by a black line.

The first cover member 12 includes a plurality of protruding portions 12*a* provided at predetermined intervals in the main scanning direction. The first cover member 12 includes a plurality of recessed portions 12*b* provided at predetermined intervals in the main scanning direction. The plurality of protruding portions 12*a* and the plurality of recessed portions 12*b* are provided on the upper surface of the first cover member 12. The plurality of protruding portions 12*a* and the plurality of recessed portions 12*b* are alternately formed. The plurality of protruding portions 12*a* and the plurality of recessed portions 12*b* are provided above the connection region.

An interval between the adjacent protruding portions 12*a* is, for example, 50 to 200 μm. An interval between the adjacent recessed portions 12*b* is, for example, 50 to 200

μm. The interval between the adjacent protruding portions 12*a* indicates a distance between portions located highest among the protruding portions 12*a* in the main scanning direction. The same applies to the interval between the adjacent recessed portions 12*b*.

A difference between the heights of the protruding portions 12*a* and the recessed portions 12*b* can be set to, for example, 20 to 40 μm. The difference between the heights of the protruding portions 12*a* and the recessed portions 12*b* can be measured by observing a surface state of the first cover member 12 with, for example, a contactless laser microscope.

The first cover member 12 is configured to be contactable with the recording medium P. In other words, the first cover member 12 may come into contact with the recording medium P depending on a conveyance situation of the recording medium P in some cases.

The base member 5*a* of the FPC 5 includes a first surface 5*c* located on the substrate side and a second surface 5*d* located opposite to the first surface 5*c*. On the first surface 5*c*, the wiring conductors 5*b* is formed, and the external terminals 4 are provided. The base member 5*a* includes a depression portion 14 in a region in which the external terminal 4 is not provided.

The depression portion 14 is depressed from a first surface 5*c* toward a second surface 5*d* in a region in which the external terminal 4 is provided. The depression portion 14 is formed in the region of the first surface 5*c* in which the external terminal 4 is not provided. In other words, the depression portion 14 is formed between the external terminals 4. Therefore, the plurality of depression portions 14 are provided at predetermined intervals in the main scanning direction.

The second surface 5*d* corresponding to the depression portion 14 protrudes upwardly. The plurality of depression portions 14 are provided at the predetermined intervals in the main scanning direction, and thus the second surface 5*d* includes protruding portions provided at the predetermined intervals in the main scanning direction.

A depth of the depression portion 14 from the first surface 5*c* of the region in which the external terminal 4 is provided (a length in a thickness direction of the substrate 7) can be set to be, for example, 20 to 40 μm. The depth of the depression portion 14 from the first surface 5*c* of the region in which the external terminal 4 is provided can be obtained, for example, by cutting the thermal head X1 in the vertical direction as in FIG. 4 and observing the cross-sectional surface of the FPC 5.

Here, when a recording medium comes into contact with the first cover member including no protruding portion, the upper surface of the first cover member is flat, and thus the recording medium comes into surface contact with the first cover member. Thus, friction between the recording medium and the first cover member may increase, the recording medium is caught, and thus there is a concern that the recording medium is wrinkled.

On the other hand, the first cover member 12 includes the plurality of protruding portions 12*a* provided on the upper surface at the predetermined intervals in the main scanning direction. Therefore, even when the first cover member 12 comes into contact with the recording medium P, the recording medium P comes into contact with the protruding portions 12*a*, but is less likely to come into contact with the recessed portions 12*b* between the protruding portions 12*a*. Thus, the recording medium P comes into point contact with the first cover member 12. Therefore, the friction between the recording medium P and the first cover member 12 does not increase and the recording medium P is less likely to be caught. As a result, the recording medium is less likely to be wrinkled.

In particular, the case of the thermal head X1 in which a glossy sheet is used as the recording medium P is useful because of the following reasons. A glossy sheet has strong resilience as the recording medium P and the recording medium P is further less likely to come into contact the recessed portions 12*b*. As a result, the recording medium P comes into point contact with the first cover member 12, and thus it is possible to reduce a possibility that the recording medium P is wrinkled and paper jamming occurs.

The first cover member 12 can be formed of an epoxy-based resin. Thus, static electricity charged to the recording medium P is discharged to, for example, the heat dissipating plate 1 through the first cover member 12. Thus, the static electricity is less likely to be discharged to the heat generating section 9. As a result, the thermal head X1 is less likely to be damaged.

The protruding portions 12*a* are provided on a part of the upper surface of the first cover member 12 which part is located above the connection region. Thus, it is possible to reduce noise caused due to an electric signal flowing in the connection portion 6.

That is, since the protruding portions 12*a* are provided on the upper surface of the first cover member 12, the surface area of the upper surface can be set to be greater than the surface area of the flat upper surface. Thus, it is likely to radiate the noise from the upper surface of the first cover member 12, and thus it is possible to reduce an influence of the noise of the connection portion 6.

The second cover member 29 is provided between the heat generating section 9 and the first cover member 12 in a plan view. In other words, the first cover member 12, the second cover member 29, and the heat generating section 9 are disposed in this order when viewed in a conveying direction of the recording medium P.

Therefore, the recording medium P comes into contact with the protruding portions 12*a* of the first cover member 12 and subsequently comes into contact with the second cover member 29 after electricity is removed. As a result, static electricity is discharged to the second cover member 29, and thus the driving IC 11 is less likely to be damaged.

The protruding portions 12*a* are disposed at positions corresponding to the depression portions 14 of the second surface 5*d*. Therefore, even when the recording medium P is excessively pressed against a platen roller 50 (see FIG. 5A), the depression portions 14 can be deformed and the protruding portions 12*a* can be displaced downwards. Therefore, the depression portions 14 can alleviate stress concentrated on the protruding portions 12*a*. As a result, damage such as crack is less likely to occur in the first cover member 12.

Figure 5A:
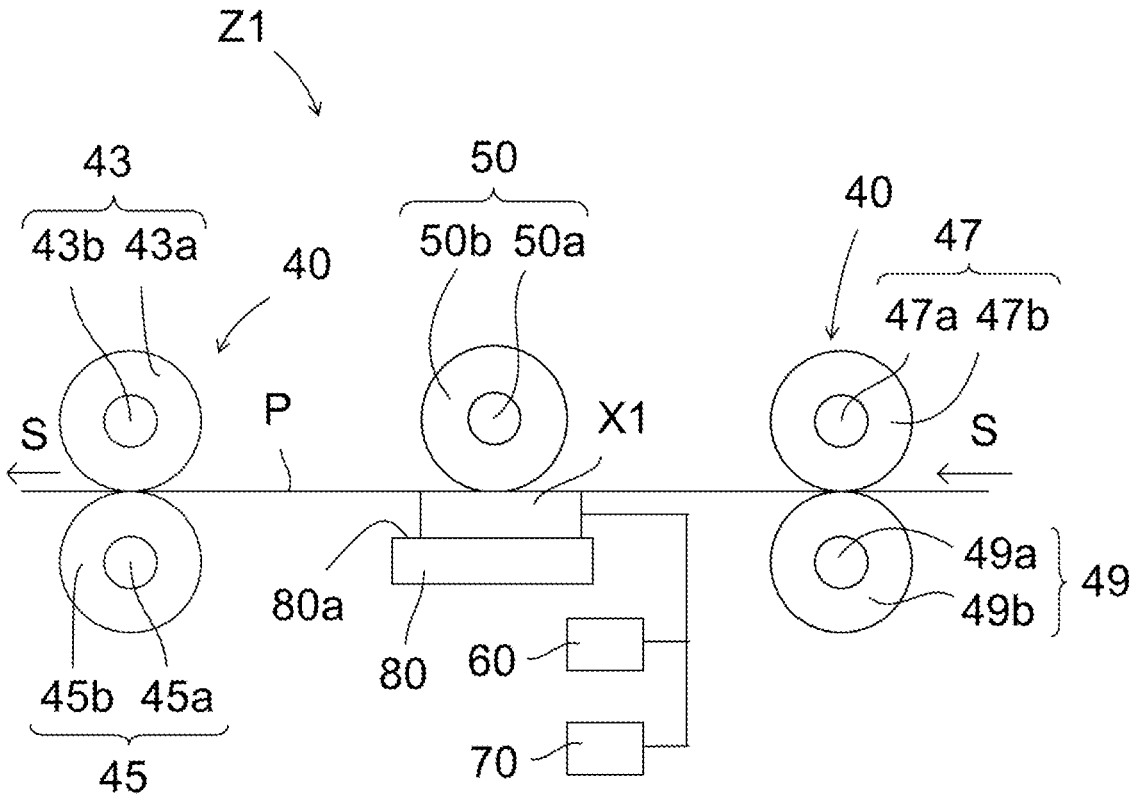
FIG. 5A is a view illustrating a schematic configuration of the thermal printer according to the first embodiment.

Here, the recording medium P can be conveyed by various rollers, as illustrated in FIG. 5A. Therefore, there is a concern that the recording medium P is at a high temperature due to friction heat generated between the recording medium P and the various rollers.

On the other hand, in the thermal head X1, space is provided between the depression portion 14 and the substrate 7. Thus, a heat insulating layer is formed between the protruding portions 12*a* and the substrate 7 and between the depression portions 14 and the substrate 7, and the heat of the recording medium P is less likely to be transferred to the substrate 7.

The first cover member 12 includes the recessed portions 12*b* between the protruding portions 12*a*, and the recessed portions 12*b* are disposed on the terminal 2. In other words, the protruding portion 12*a* coming into contact with the recording medium P is not disposed on the terminal 2. Therefore, even when static electricity charged to the recording medium P is discharged to the first cover member 12, the static electricity is discharged to the protruding portion 12*a* located closely. Therefore, it is possible to reduce a possibility of the static electricity discharged to the terminal 2. As a result, the terminal 2 is less likely to be destroyed by the static electricity.

The thermal head X1 can be manufactured according to the following method, for example.

First, the external terminals 4 of the FPC 5 are electrically connected to the terminals 2 of the head base body 3 via the conductive members 23. Subsequently, the conductive members 23 are reflowed to electrically connect the terminals 2 of the head base body 3 to the external terminals 4 of the FPC 5.

Subsequently, the first cover member 12 is applied with a constant thickness using a dispenser or the like so that the connection portions 6 are sealed, and is cured. Continuously, the first cover member 12 is applied again by the dispenser in portions in which the protruding portions 12*a* are formed, and is dried. Thus, the protruding portions 12*a* can be formed on the upper surface of the first cover member 12.

After the first cover member 12 is applied with a constant thickness using the dispenser or the like so that the connection portions 6 are sealed, a pressing plate with an uneven surface may be pressed against an applied surface to form the protruding portions 12*a*.

An example in which the protruding portions 12*a* and the recessed portions 12*b* are provided in the connection region has been described, but the invention is not limited to this. The protruding portions 12*a* and the recessed portions 12*b* may be formed on an upper surface of the first cover member 12 other than the connection region.

A configuration in which the base member 5*a* includes the depression portions 14 has been described, but the depression portions 14 may not be provided.

Next, a thermal printer Z1 will be described with reference to FIGS. 5A and 5B.

As illustrated in FIG. 5A, the thermal printer Z1 according to the embodiment includes the above-described thermal head X1, a conveyance mechanism 40, a platen roller 50, a power supply device 60, and a control unit 70. The thermal head X1 is mounted on a mounting surface 80*a* of a mounting member 80 provided in a housing (not illustrated) of the thermal printer Z1. The thermal head X1 is mounted in the mounting member 80 so that the arrangement direction of the heat generating sections 9 follows the main scanning direction which is a direction perpendicular to a conveying direction S of the recording medium P to be described below.

The conveyance mechanism 40 comprises a driving section (not shown) and conveying rollers 43, 45, 47 and 49. The conveyance mechanism 40 serves to convey the recording medium P such as thermal paper or ink-transferable image-receiving paper, in a direction indicated by the arrow S shown in FIGS. 5A and 5B so as to move the recording medium P onto the protective layer 25 located on the plurality of heat generating sections 9 of the thermal head X1. The driving section functions to drive the conveying rollers 43, 45, 47 and 49, and, for example, a motor may be used for the driving section. For example, the conveying roller 43, 45, 47, 49 is composed of a cylindrical shaft body 43*a*, 45*a*, 47*a*, 49*a* formed of metal such as stainless steel covered with an elastic member 43*b*, 45*b*, 47*b*, 49*b* formed of butadiene rubber, for example. Although not shown in the drawing, when using ink-transferable image-receiving paper or the like as the recording medium P, the recording medium P is conveyed together with an ink film which lies between the recording medium P and the heat generating section 9 of the thermal head X1.

The platen roller 50 functions to press the recording medium P against the top of the protective layer 25 located on the heat generating section 9 of the thermal head X1. The platen roller 50 is disposed so as to extend along a direction perpendicular to the conveying direction S of the recording medium P, and is fixedly supported at ends thereof so as to be rotatable while pressing the recording medium P against the top of the heat generating section 9. For example, the platen roller 50 may be composed of a cylindrical shaft body 50*a* formed of metal such as stainless steel covered with an elastic member 50*b* formed of butadiene rubber, for example.

The power supply device 60 functions to supply electric current for enabling the heat generating section 9 of the thermal head X1 to generate heat as described above, as well as electric current for operating the driving IC 11. The control unit 70 functions to feed a control signal for controlling the operation of the driving IC 11 to the driving IC 11 in order to cause the heat generating sections 9 of the thermal head X1 to selectively generate heat as described above.

Figure 5B:
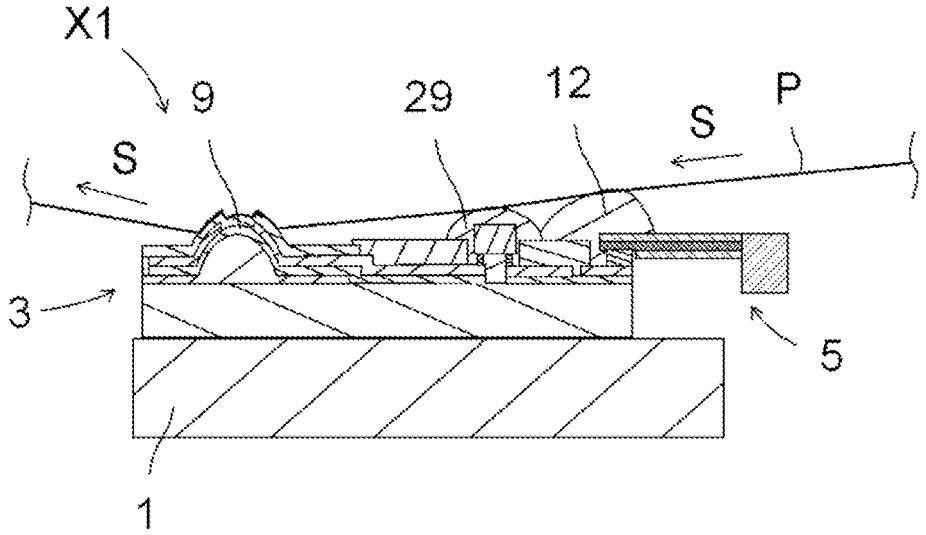
FIG. 5B is a view illustrating a conveyance state of a recording medium.

As illustrated in FIG. 5B, in the thermal printer Z1, the second cover member 29 is disposed upstream in the conveying direction S from the first cover member 12. For the recording medium P, predetermined printing is performed on the recording medium P when the power supply device 60 and the control device 70 causes the heat generating sections 9 to selectively generate heat while causing the platen roller 50 to press the recording medium P against a top of the heat generating sections 9 of the thermal head X1 and causing the conveyance mechanism 40 to convey the recording medium P onto the heat generating sections 9 so that the recording medium P sequentially comes into contact with the first cover member 12 and the second cover member 29. When the recording medium P is an image-receiving sheet, the printing is performed on the recording medium P by thermally transferring ink of an ink film (not illustrated) conveyed along with the recording medium P to the recording medium P.

Second Embodiment

Figure 6A:
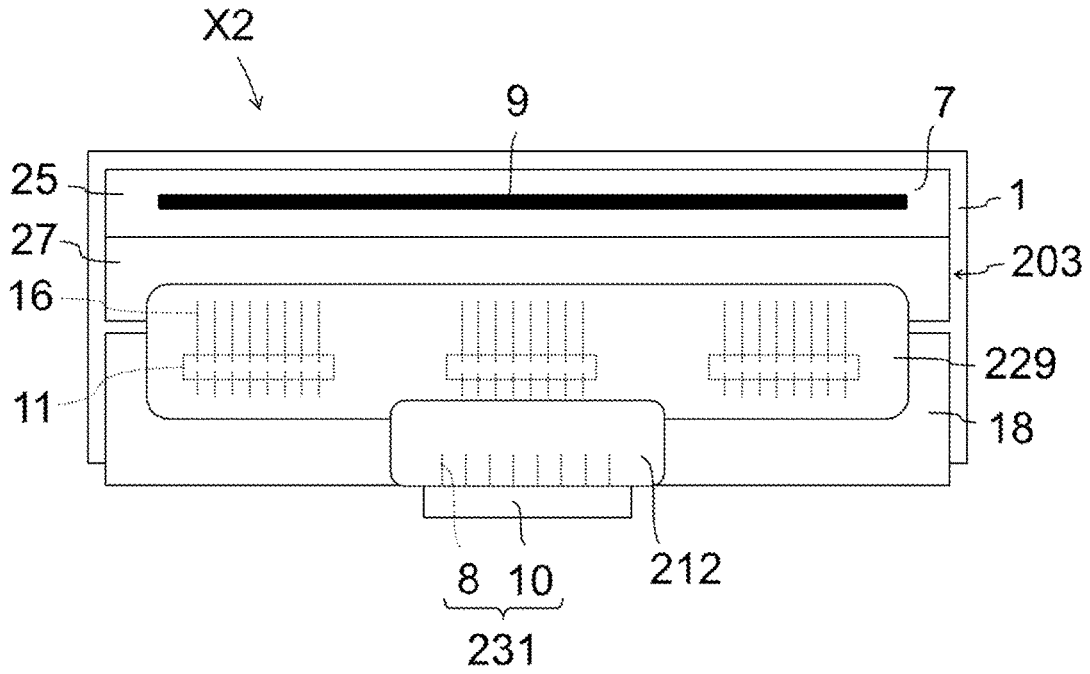
Figure 6B:
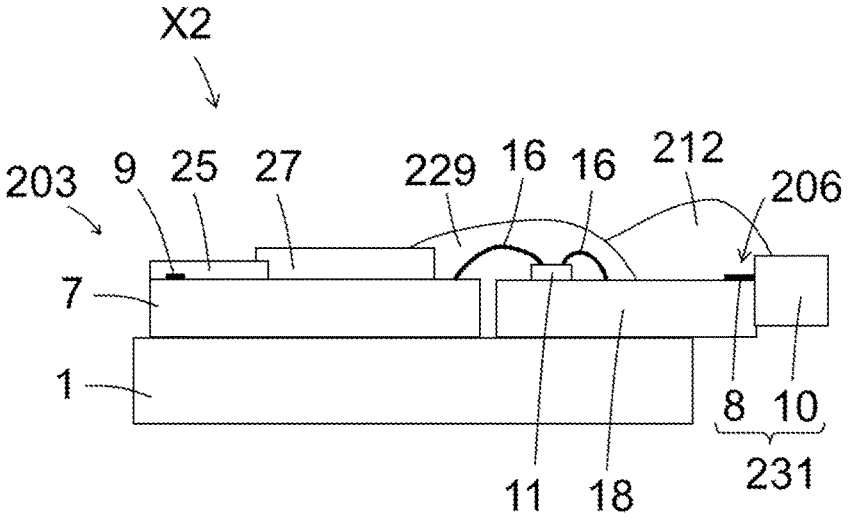

A thermal head X2 will be described with reference to FIGS. 6A to 8. The same reference numerals are given to the same members as those of the first embodiment. In FIGS. 6A and 6B, the heat generating section 9, connector pins 8, and wires 16 are indicated by thick lines.

The thermal head X2 includes a heat dissipating plate 1, a head base body 203, a wiring substrate 18, a connector 231 which is a connection member, and a first cover member 212. The head base body 203 and the wiring substrate 18 are placed on the heat dissipating plate 1. The connector 231 is electrically connected to the wiring substrate 18. In a second embodiment, the connector 231 will be described as the connection member.

The plurality of driving ICs 11 are disposed on the wiring substrate 18 and the wires 16 disposed on the upper surface of the driving ICs 11 electrically connect the head base body 203 to the wiring substrate 18. A second cover member 229 is configured to cover the plurality of driving ICs 11. The second cover member 229 is formed to be long in the main scanning direction.

The connector 231 includes the connector pins 8 and a housing 10. The connector pins 8 are electrically connected to the wiring substrate 18. The housing 10 accommodates the connector pins 8. The sockets are inserted into the housing 10 from the outside so that the head base body 203 is electrically connected to the outside.

The first cover member 212 is provided on the wiring substrate 18 and the housing 10 so as to cover a connection portions 206.

Figure 7:
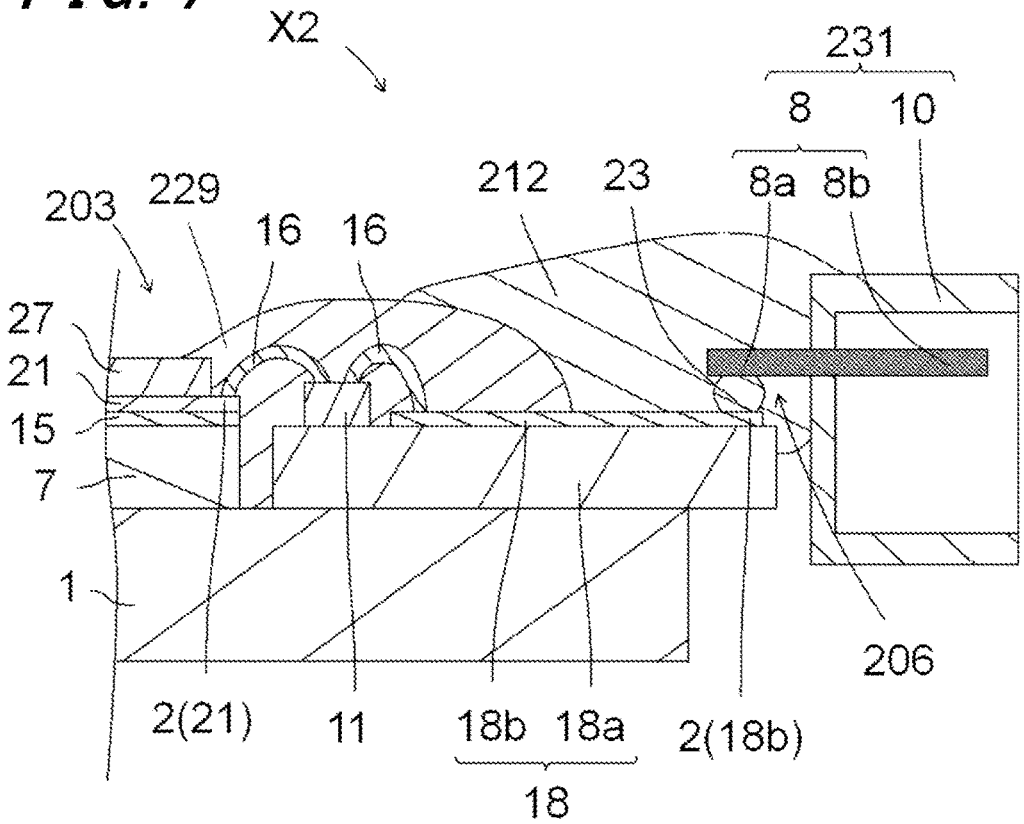
FIG. 7 is a sectional view illustrating a part of the thermal head according to the second embodiment.

The wiring substrate 18, the connector 231, and the first cover member 212 will be described in detail with reference to FIGS. 7 and 8.

The wiring substrate 18 is placed on the upper surface of the heat dissipating plate 1 to be adjacent to the head base body 203. The wiring substrate 18 includes a base member 18*a* and a wiring conductor 18*b*. The driving ICs 11 and the wires 16 are disposed on the wiring substrate 18.

The base member 18*a* is formed in a rectangular shape in a plan view and has substantially the same shape as the wiring substrate 18. The wiring conductor 18*b* is provided in the base member 18*a* and is patterned in a planar direction, although not illustrated. The wiring conductor 18*b* includes the terminal 2 electrically connected to a connection portion 206 on the side of the connector 231. The terminals 2 are provided at predetermined intervals in the main scanning direction.

The driving IC 11 is placed in a region in which the wiring conductor 18*b* is not provided on the base member 18*a*. One pair of wires 16 is extracted from the upper surface of the driving IC 11, and includes a first wire 16 and a second wire 16. The first wire 16 is electrically connected to the connection electrode 21 of the head base body 3. The second wire 16 is electrically connected to the wiring conductor 18*b* of the wiring substrate 18.

In the connector 231, the housing 10 is disposed at intervals from the side surface of the wiring substrate 18. Each of the plurality of connector pins 8 includes a first end 8*a* and a second end 8*b*. The first end 8*a* is exposed to the outside of the housing 10 and is electrically connected to the terminal 2. That is, the first end 8*a* functions as the external terminal 4 of the connector (connection member) 231. The second end 8*b* is accommodated inside the housing 10. The connector pins 8 have electrical conductivity and can be formed of metal or an alloy. The housing 10 can be formed of an insulating member.

The first end 8*a* is electrically connected to the terminal 2 of the wiring substrate 18 via the conductive member 23. Therefore, in the second embodiment, the connection portion 206 is constituted by the conductive member 23.

The first cover member 212 is provided to protect the connection region and is provided to cover the terminals 2, the conductive members 23, and the first ends 8*a*. In the present embodiment, the first cover member 212 is provided over the entire region of the terminals 2, the conductive members 23, and the first ends 8*a*. Therefore, the first cover member 212 seals the terminals 2, the conductive members 23, and the first ends 8*a*. A part of the first cover member 212 is disposed on the housing 10 of the second cover member 29.

Figure 8:
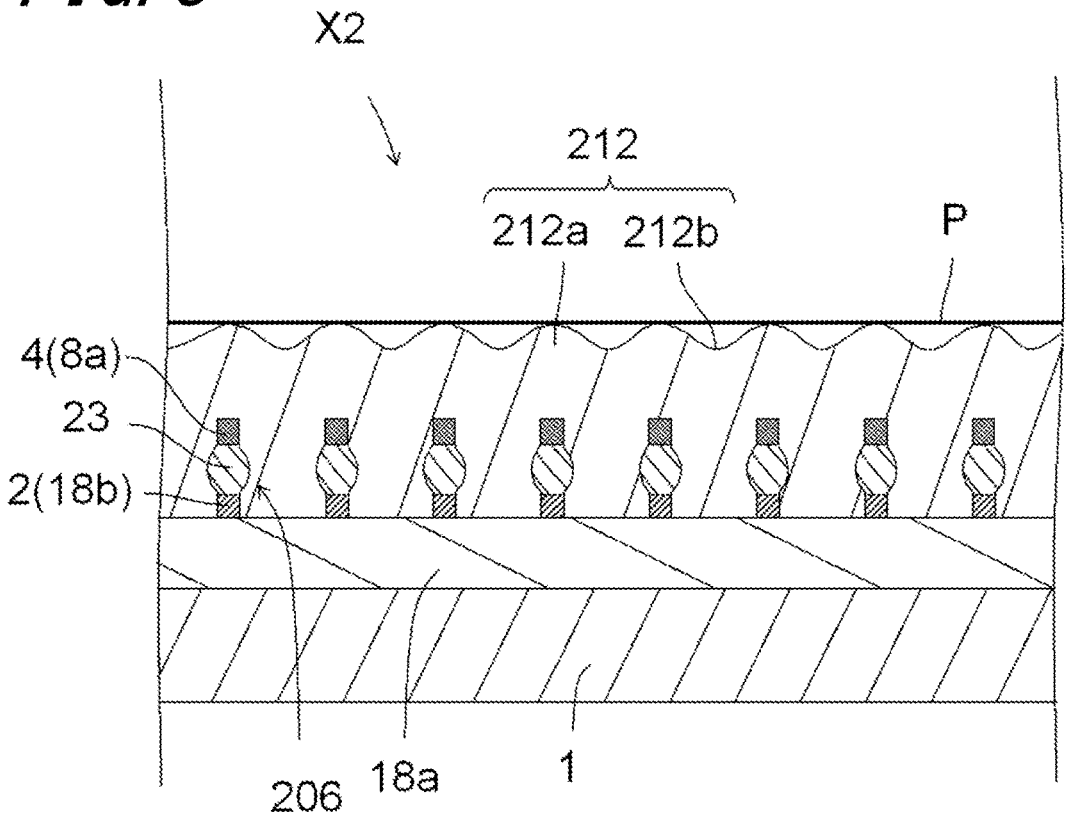
FIG. 8 is a sectional view corresponding to FIG. 4 and illustrating the thermal head according to the second embodiment.

As illustrated in FIG. 8, the first cover member 212 includes a plurality of protruding portions 212*a* provided at predetermined intervals in the main scanning direction. The first cover member 212 includes a plurality of recessed portions 212*b* provided at predetermined intervals in the main scanning direction. The plurality of protruding portions 212*a* and the plurality of recessed portions 212*b* are provided on the upper surface of the first cover member 212. The plurality of protruding portions 212*a* and the plurality of recessed portions 212*b* are alternately provided in the main scanning direction. The plurality of protruding portions 212*a* and the plurality of recessed portions 212*b* are formed above the connection region.

An interval between the mutually adjacent protruding portions 212*a* is, for example, 1 to 5 mm. An interval between the adjacent recessed portions 212*b* is, for example, 1 to 5 mm.

A difference between the heights of the protruding portions 212*a* and the recessed portions 212*b* can be set to, for example, 50 to 200 μm. The difference between the heights of the protruding portions 212*a* and the recessed portions 212*b* can be measured by observing a surface state of the first cover member 212 with, for example, a contactless laser microscope.

The first cover member 212 is configured to be contactable with the recording medium P. That is, the recording medium P comes into contact with the first cover member 212, and subsequently comes into contact with the protective film 25 (see FIG. 3) on the heat generating sections 9 so that printing is performed.

The first cover member 212 includes the protruding portions 212*a* provided at the predetermined intervals in the main scanning direction on the upper surface. Thus, the recording medium P comes into contact with the protruding portions 212*a* and is less likely to come into contact with the recessed portions 212*b* located between the protruding portions 212*a*. Therefore, the recording medium P comes into point contact with the first cover member 212. Therefore, the friction between the recording medium P and the first cover member 212 does not increase and the recording medium P is less likely to be caught. As a result, the recording medium is less likely to be wrinkled.

The plurality of protruding portions 212*a* are provided at positions corresponding to the plurality of connector pins 8, respectively. Thus, the protruding portions 212*a* of the first cover member 212 can be supported by the connector pins 8, and the first cover member 212 can stably convey the recording medium P.

The first cover member 212 is disposed to surround the connection portions 206. Thus, mechanical connection of the connection portions 206 can be stabilized. As a result, it is possible to improve electric connection reliability of the connection portions 206.

Third Embodiment

Figure 9:
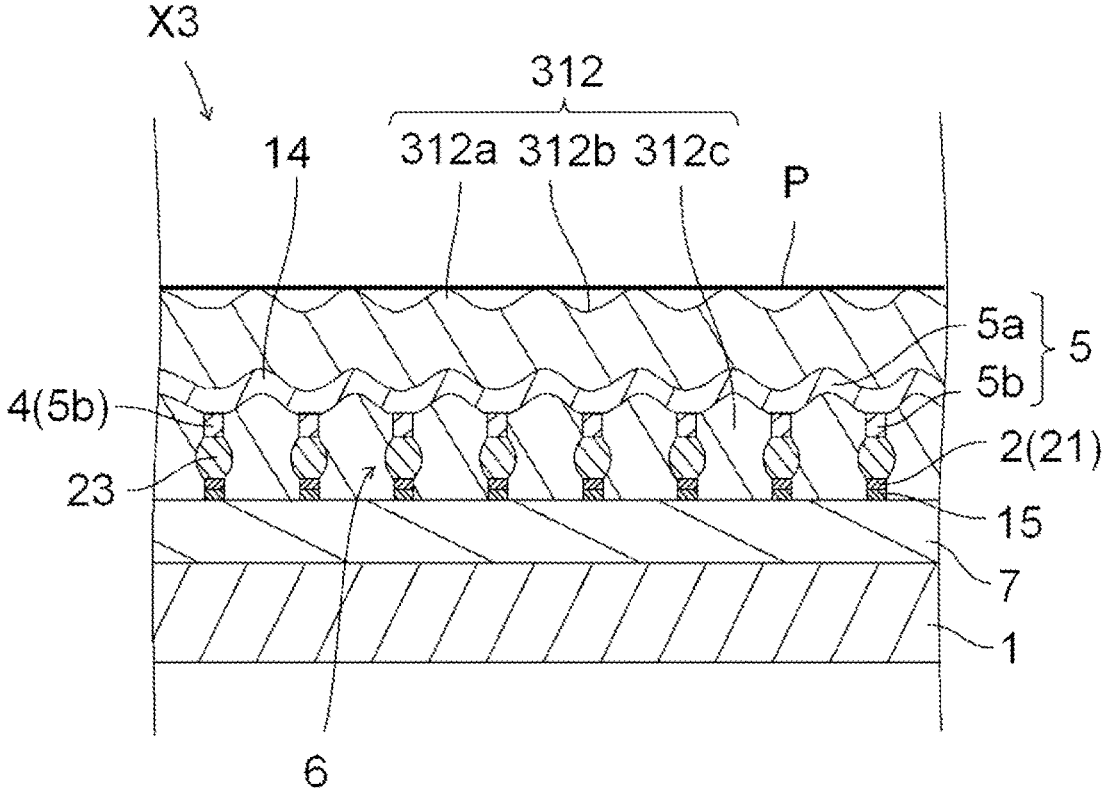
FIG. 9 is a sectional view corresponding to FIG. 4 and illustrating a thermal head according to a third embodiment.

A thermal head X3 will be described with reference to FIG. 9. The thermal head X3 is different from the thermal head X1 in the configuration of a first cover member 312. The other configuration is the same as the thermal head X1 and the description thereof will be omitted.

The first cover member 312 includes a plurality of protruding portions 312*a*, a plurality of recessed portions 312*b*, and an infiltration portion 312*c*. The plurality of protruding portions 312*a* and the plurality of recessed portions 312*b* are provided on the upper surface of the first cover member 312. The infiltration portion 312*c* is disposed in a portion of the first cover member 312 located between the FPC 5 and the substrate 7. The infiltration portion 312*c* is filled between the FPC 5 and the substrate 7.

The infiltration portion 312*c* penetrates between the FPC 5 and the substrate 7, and thus an end of the FPC 5 located on the substrate 7 is sandwiched by the first cover member 312. In other words, the first cover member 312 is disposed over the entire region around the end of the FPC 5 located on the substrate 7. As a result, the end of the FPC 5 located on the substrate 7 is less likely to be separated. Therefore, the FPC 5 is less likely to be separated from the head base body 3.

Further, since the infiltration portion 312*c* is filled between the FPC 5 and the substrate 7, the first cover member 312 is disposed around the conductive members 23. Therefore, the infiltration portion 312*c* can protect the conductive members 23. As a result, the electric connection between the head base body 3 and the FPC 5 can be stabilized.

Fourth Embodiment

Figure 10:
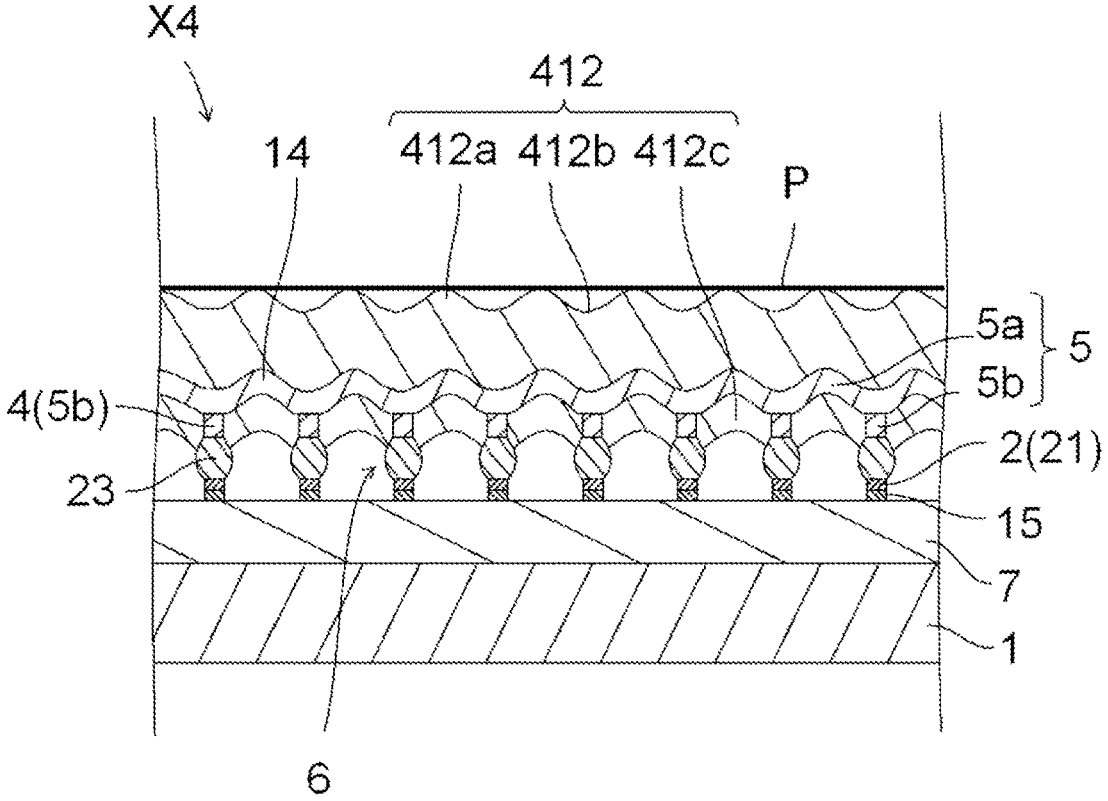
FIG. 10 is a sectional view corresponding to FIG. 4 and illustrating a thermal head according to a fourth embodiment.

A thermal head X4 will be described with reference to FIG. 10. The thermal head X4 is different from the thermal head X3 in the configuration of a first cover member 412. The other configuration is the same as the thermal head X3 and the description thereof will be omitted.

The first cover member 412 includes a protruding portion 412*a*, a recessed portion 412*b*, and an infiltration portion 412*c*. The infiltration portion 412*c* is provided on the side of the FPC 5 without being filled between the FPC 5 and the substrate 7. In other words, a space is provided between the infiltration portion 412*c* and the substrate 7. Therefore, a part of the conductive member 23 is provided to be exposed from the infiltration portion 412*c*. Then, the conductive member 23 is formed by solder.

Here, when the large quantity of infiltration portion 412*c* penetrates between the FPC 5 and the substrate 7, the conductive member 23 is pressed by the infiltration portion 412*c*, and thus there is a concern of contact with the nearby located conductive member 23. That is, there is a concern of short-circuiting.

On the other hand, in the thermal head X4, an inflow amount of the infiltration portion 412*c* can be reduced and a pressing force applied from the infiltration portion 412*c* can be reduced. As a result, the conductive member 23 is less likely to come into contact with the adjacent conductive member 23, and thus short-circuiting is less likely to occur in the thermal head X4.

Further, the infiltration portion 412*c* includes a portion located between the connection portions 6. Then, in the infiltration portion 412*c*, a surface of the portion located between the connection portions 6 on the side of the substrate 7 protrudes upwardly. More specifically, the surface of the infiltration portion 412*c* located between the conductive members 23 on the side of the substrate 7 has an upward protruding shape in a sectional view. Therefore, the infiltration portion 412*c* is easily deformed by a pressing force from above. Therefore, the infiltration portion 412*c* can disperse the pressing force from above.

In particular, when the infiltration portion 412*c* is located below the protruding portion 412*a*, the infiltration portion 412*c* can further disperse the pressing force from above. That is, the protruding portions 412*a* are configured to come into contact with the recording medium P, and thus a pressing force is applied to the protruding portions 412*a* downwards. On the other hand, the infiltration portion 412*c* serves to disperse the pressing force, and the first cover member 412 is less likely to be damaged by the pressing force.

While one embodiment according to the disclosure has been described heretofore, it should be understood that the invention is not limited to the above-described embodiment, and that various modifications and variations are possible without departing from the scope of the invention. For example, although the thermal printer Z1 employing the thermal head X1 according to the first embodiment has been shown herein, it is not intended to be limiting of the invention, and thus, any of the thermal heads X2 to X4 may be adopted for use in the thermal printer Z1. Moreover, the thermal heads X1 to X4 according to a plurality of embodiments may be used in combination.

In the thermal head X1, the bulge portion 13*b* is formed in the thermal storage layer 13 and the electrical resistance layer 15 is formed on the bulge portion 13*b*, but the invention is not limited to this. For example, the bulge portion 13*b* may not be formed in the thermal storage layer 13 and the heat generating section 9 of the electrical resistance layer 15 may be disposed on the underlying portion 13*a* of the thermal storage layer 13. The thermal storage layer 13 may be provided across the upper surface of the substrate 7.

In the thermal head X1, the common electrode 17 and the discrete electrode 19 are formed on the electrical resistance layer 15, but the invention is not limited to this as long as both the common electrode 17 and the discrete electrode 19 are connected to the heat generating section 9 (electric resistor). For example, the heat generating section 9 may be constituted by forming the common electrode 17 and the discrete electrode 19 on the thermal storage layer 13 and forming the electrical resistance layer 15 only in a region between the common electrode 17 and the discrete electrode 19.

Furthermore, although the thin-film head having the thin heat generating section 9 obtained by forming the electrical resistance layer 15 in thin-film form has been described as exemplification, the invention is not limited to this. For example, the invention may be embodied as a thick-film head having a thick heat generating section 9 by patterning various electrodes and subsequently forming the electrical resistance layer 15 in thick-film form. Further, the present technology may be embodied as an edge-type head in which the heat generating section 9 is disposed on an end face of the substrate.

REFERENCE SIGNS LIST

X1-X4: Thermal head
Z1: Thermal printer
1: Heat dissipating plate
2: Terminal
3: Head base body
4: External terminal
5: Flexible printed circuit (connection member)
5*a*: Base member
5*b*: Wiring conductor
5*c*: Cover member
6, 206: Connection portion
7: Substrate
8: Connector pin
8*a*: First end
8*b*: Second end
9: Heat generating section
10: Housing
11: Driving IC
12, 212, 312, 412: First cover member
12*a*, 212*a*, 312*a*, 412*a*: Protruding portion
12*b*, 212*b*, 312*b*, 412*b*: Recessed portion
312*c*, 412*c*: Infiltration portion

14: Depression portion
16: Wire
18: Wiring substrate
18*a*: Base member
18*b*: Wiring conductor
23: Conductive member
29, 229: Second cover member
31, 231: Connector (connection member)

The invention claimed is:

1. A thermal head, comprising:
a head base body, wherein the head base body includes:
a substrate,
a plurality of heat generating sections disposed on the substrate, and
a plurality of first terminals electrically connected to the plurality of heat generating sections;
a connection member that includes a plurality of second terminals electrically connected to the plurality of first terminals, respectively,
a conductive member that connects each of the plurality of first terminals and each of the plurality of second terminals;
a first cover member that covers a first connection region in which the plurality of second terminals of the connection member are arranged, wherein the first cover member includes:
a plurality of protruding portions that are located on part of an upper surface of the first cover member at predetermined intervals in a main scanning direction, and
an infiltration portion that penetrates between the connection member and the head base body.

2. The thermal head according to claim 1, further comprising:
a driving IC which is electrically connected to the heat generating sections; and
a second cover member which covers the driving IC,
wherein the second cover member is provided between the heat generating sections and the first cover member in a plan view of the thermal head.

3. The thermal head according to claim 1, wherein: the connection member further includes:
a base member that includes a first surface located on a substrate side, a second surface located on an opposite side to the first surface and depression portions in a region of the first surface in which the plurality of second terminals are not formed, and
a wiring conductor which is disposed on the first surface; and
the protruding portions of the first cover member are located on the second surface at positions corresponding to the depression portions.

4. The thermal head according to claim 3, wherein a space is provided between the depression portions and the substrate.

5. The thermal head according to claim 3, wherein the first cover member comprises recessed portions between the protruding portions, and
the recessed portions are disposed above the first terminals, respectively.

6. The thermal head according to claim 1, wherein the plurality of first terminals are formed of solder, and
the solder is exposed from the infiltration portion.

7. The thermal head according to claim 1, wherein:
the infiltration portion further includes a portion located between the plurality of first terminals, and
in a sectional view, a surface of the portion located between the plurality of first terminals on a substrate side protrudes upwardly.

8. A thermal printer, comprising:
the thermal head according to claim 1;
a conveyance mechanism which conveys a recording medium on the heat generating sections; and
a platen roller which presses the recording medium against a top of the heat generating sections.

9. The thermal head according to claim 1, wherein
the first cover member is in operable contact with a recording medium.

10. A thermal head, comprising:
a head base body that includes:
a substrate, and
a plurality of heat generating sections disposed on the substrate,
a wiring substrate adjacent to the head base body, wherein the wiring substrate includes a plurality of third terminals electrically connected to the plurality of heat generating sections;
a connection member that includes a plurality of fourth terminals electrically connected to the plurality of third terminals, respectively;
a conductive member which electrically connects the wiring substrate and the connection member via the plurality of third terminals and the plurality of fourth terminals; and
a first cover member that covers a second connection region in which the plurality of fourth terminals in the connection member are arranged, wherein the first cover member includes:
a plurality of protruding portions that are located on part of an upper surface of the first cover member at predetermined intervals in a main scanning direction, and
an infiltration portion that penetrates between the connection member and the wiring substrate.

11. The thermal head according to claim 10, wherein:
the connection member further includes:
a base member that includes a first surface located on a substrate side, a second surface located on an opposite side to the first surface, and depression portions in a region of the first surface in which the plurality of fourth terminals are not formed, and
a wiring conductor which is disposed on the first surface;
the protruding portions of the first cover member are located at positions corresponding to the depression portions of the second surface.

12. The thermal head according to claim 10, wherein the plurality of third terminals are formed of solder, and
the solder is exposed from the infiltration portion.

13. A thermal head, comprising:
a head base body including:
a substrate,
a plurality of terminals, and
a plurality of heat generating sections disposed on the substrate;
connection portions;
a connection member which connects the head base body to an outside via the connection portions, wherein the plurality of terminals are electrically connected to the connection member; and
a first cover member which covers the connection portions, wherein the first cover member includes a plurality of protruding portions provided on an upper surface of the first cover member at predetermined intervals in a main scanning direction, wherein the connection member includes:

a plurality of external terminals electrically connected to the plurality of terminals, respectively, a base member that includes a first surface located on a substrate side, a second surface located on an opposite side to the first surface, and depression portions in a region of the first surface in which the external terminals are not formed, and a wiring conductor which is disposed on the first surface.

14. The thermal head according to claim 13, wherein the protruding portions of the first cover member are located at positions corresponding to the depression portions of the second surface.

* * * * *